US009009873B2

(12) United States Patent
Chiang

(10) Patent No.: US 9,009,873 B2
(45) Date of Patent: Apr. 21, 2015

(54) SWIMMING GOGGLES

(71) Applicant: Global Esprit Inc., New Taipei (TW)

(72) Inventor: Herman Chiang, New Taipei (TW)

(73) Assignee: Global Esprit Inc., New Taipei (TW)

( * ) Notice: Subject to any disclaimer, the term of this patent is extended or adjusted under 35 U.S.C. 154(b) by 148 days.

(21) Appl. No.: 13/859,726

(22) Filed: Apr. 9, 2013

(65) Prior Publication Data

US 2014/0283288 A1 Sep. 25, 2014

(30) Foreign Application Priority Data

Mar. 20, 2013 (TW) ..... 102205124 U

(51) Int. Cl.
*A61F 9/02* (2006.01)
*A63B 33/00* (2006.01)

(52) U.S. Cl.
CPC ..... *A63B 33/002* (2013.01)

(58) Field of Classification Search
CPC ..... A61F 9/00; A61F 9/02; A61F 9/027
USPC ..... 2/426, 428, 439–446, 448, 450
See application file for complete search history.

(56) References Cited

U.S. PATENT DOCUMENTS

| | | | | | |
|---|---|---|---|---|---|
| 5,524,300 | A * | 6/1996 | Chiang | ..... | 2/439 |
| 5,682,621 | A * | 11/1997 | Park | ..... | 2/441 |
| 5,687,428 | A * | 11/1997 | Yamamoto | ..... | 2/445 |
| 5,711,035 | A * | 1/1998 | Haslbeck | ..... | 2/436 |
| 5,734,995 | A * | 4/1998 | Chiang | ..... | 2/428 |
| 6,145,133 | A * | 11/2000 | Sato et al. | ..... | 2/428 |
| 6,151,720 | A * | 11/2000 | Chiang | ..... | 2/428 |
| 6,289,523 | B1 * | 9/2001 | Chiang | ..... | 2/428 |
| 8,402,569 | B2 * | 3/2013 | Chiang | ..... | 2/442 |
| 2008/0072366 | A1 * | 3/2008 | Fukasawa | ..... | 2/445 |

* cited by examiner

*Primary Examiner* — Gloria Hale
(74) *Attorney, Agent, or Firm* — Cheng-Ju Chiang

(57) ABSTRACT

Swimming goggles includes left and right frames integrally formed together, a connecting element for interconnecting the left and right frames, protection pads, lenses installed in the left and right frames, buckles integrally formed on side portions of the left and right frames, and a head strap being movably connected with the buckles. Each of the buckles has a main body which is disposed on and integrally formed with the corresponding side portion of the left/right frame. More specifically, the buckles are capable of forming a part of the lenses, or a part of the left and right frames. Additionally, the main body is defined with a through hole for simplifying the structure of the swimming goggles and for making assembly of the swimming goggles less difficult, and further for efficiently reducing a cost for assembly of the swimming goggles.

8 Claims, 8 Drawing Sheets

SWIMMING GOGGLES

BACKGROUND OF THE INVENTION

1. Field of the Invention

The present invention relates to swimming goggles, and particularly to swimming goggles that is simplified and ergonomic in design, perfect fit and comfortable in wearing, and is watertight in use.

2. Related Art

A structure of swimming goggles relating to the present invention has left and right frames and a connecting element that are integrally formed together. For such swimming goggles, lenses are assembled with the left and right frames in a manner of implantation, and the left and right frames are provided with buckles for a head strap to pass therethrough. The buckles provide functions to not only position the head strap but also limit the head strap to move in one direction so as to allow the head strap to be adjustable to a proper length. However, the buckles are mostly connected with the left and right frames for which the assembly with other parts of the swimming goggles is needed to be considered by utilizing extra and more components. Consequently, a cost for assembly is increased because of multiple and complicated components, and the overall swimming goggles is increased in size as well for the same reason, and is not compatible with a light and simple trend in design.

SUMMARY OF THE INVENTION

Accordingly, an object of the present invention is to provide swimming goggles having a simple structure by simplifying buckles and skillfully integrating the buckles with existed components, so as to make assembly of the swimming goggles less difficult, and further reduce a cost for assembly.

Another object of the present invention is to provide buckles that are intended to enable a head strap to be adjusted in length quickly and easily without taking off the swimming goggles so as to achieve the effect of convenient use.

To achieve the above objects, the swimming goggles of the present invention comprise left and right frames integrally formed together, a connecting element for interconnecting the left and right frames, protection pads, lenses installed in the left and right frames, buckles integrally formed on side portions of the left and right frames, and a head strap being movably connected with the buckles, wherein each of the buckles comprises a main body which is disposed on and integrally formed with the corresponding side portion of the left/right frame, and the main body is defined with a through hole for positioning the head strap.

According to one aspect of the present invention, the main body has a plate-like shape and integrally extends from an edge of each of the lenses to be embedded into the side portion of the left/right frame. The main bodies form a part of the lenses. The side portions of the left and right frames are formed with frame holes corresponding to the through holes.

According to another aspect of the present invention, the main body is smoothly connected to the side portion of the left/right frame in such a manner that upper and lower sides of the main body are smoothly connected with upper and lower sides of the side portion of the left/right frame, and forms a part of the left/right frame.

According to another aspect of the present invention, a rectangular pillar is longitudinally disposed in the through hole of the main body, and divides the through hole into a first guiding portion and a second guiding portion. A guiding end of the head strap passes through the first guiding portion to go around the rectangular pillar then through the second guiding portion in such a manner that the head strap is bent at approximate 90 degrees around and against the rectangular pillar, whereby the guiding end is capable of being drawn rearward to tighten the head strap in only one direction. Other portion of the head strap is defined between a wearer's head and the rectangular pillar. When the main body is not pulled outward, the other portion of the head strap is not drawable because the other portion is in frictional engagement with the rectangular pillar. When the head strap is to be loosened, the main body is being pulled outward, the other portion of the head strap is thus drawable rearward because an angle between the other portion and the rectangular pillar is increased. Accordingly, adjustment of the head strap for loosening or tightening is performed without taking off the swimming goggles.

DESCRIPTION OF THE PREFERRED EMBODIMENTS

Figure 1:
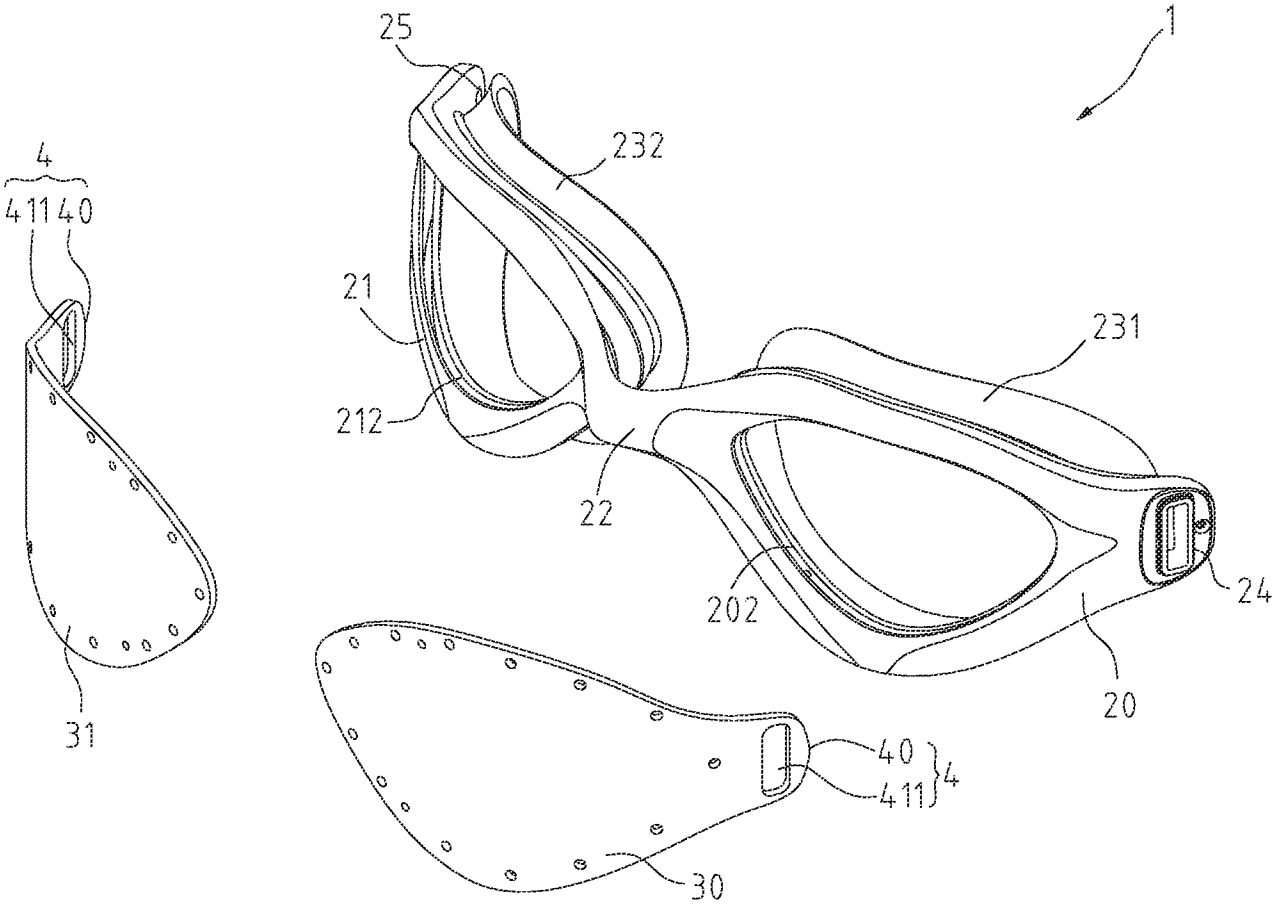
FIG. 1 is a perspective exploded view of swimming goggles in accordance with a first embodiment of the present invention.
Figure 2:
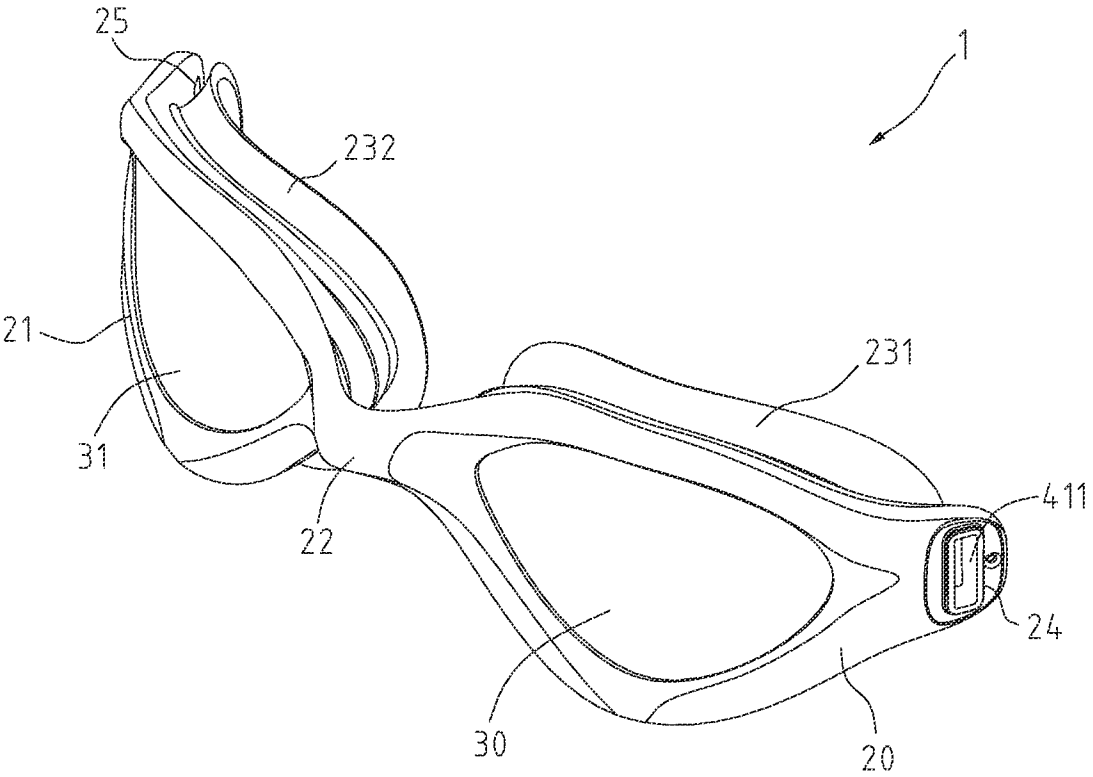
FIG. 2 is a perspective assembly view of FIG. 1.
Figure 3:
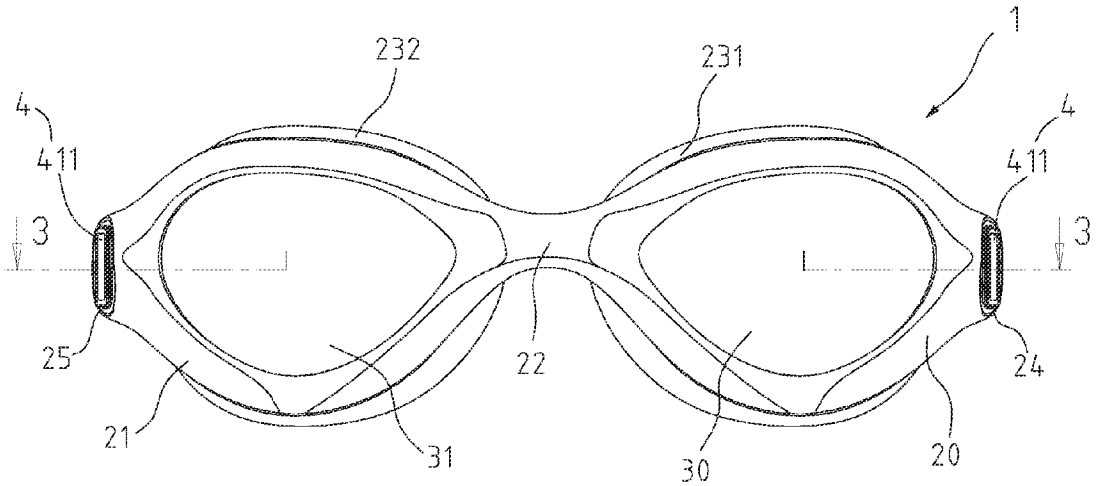
FIG. 3 is a front elevational view of FIG. 2.

Referring to FIGS. 1 to 4 showing a first embodiment of swimming goggles of the present invention, the swimming goggles 1 of the present invention comprise: left and right frames 20 and 21, a connecting element 22, lenses 30 and 31, buckles 4, and a head strap (not shown in this embodiment), wherein the left and right frames 20 and 21, and the connecting element 22 are integrally made of thermal plastic rubber by means of injection molding. Additionally, each of the left and right frames 20 and 21 is defined with a connecting opening 202 and 212 for receiving the lenses 30 and 31. Protection pads 231 and 232 are integrally formed with the lenses 30 and 31 for providing comfortable and watertight contact with a user's face when being worn. The lenses 30 and 31 are made of polycarbonate resin or cellulose acetate or cellulose propionate sheet, and peripheral sides of the lenses 30 and 31 are integrally enveloped by the left and right frames 20 and 21 at the time when the left and right frames 20 and 21 and the connecting element 22 are in the process of integral injection molding.

Each of the buckles 4 is integrally formed with side portions of the left and right frames 20 and 21, and comprises a main body 40 which is made of polycarbonate resin as same as the lenses 30 and 31. In this preferable embodiment, the main body 40 has a plate-like shape and forms a through hole 411 thereon. In particular, the main body 40 integrally extends rearward and temporally from an edge of each of the lenses 30 and 31, and therefore forms a part of the lenses 30 and 31. The main bodies 40 and part of the lenses 30 and 31 are embedded in the side portions of the left and right frames 20 and 21. The side portions of the left and right frames 20 and 21 are formed with frame holes 24 and 25 corresponding to the through holes 411 for securing the head strap.

Figure 4:
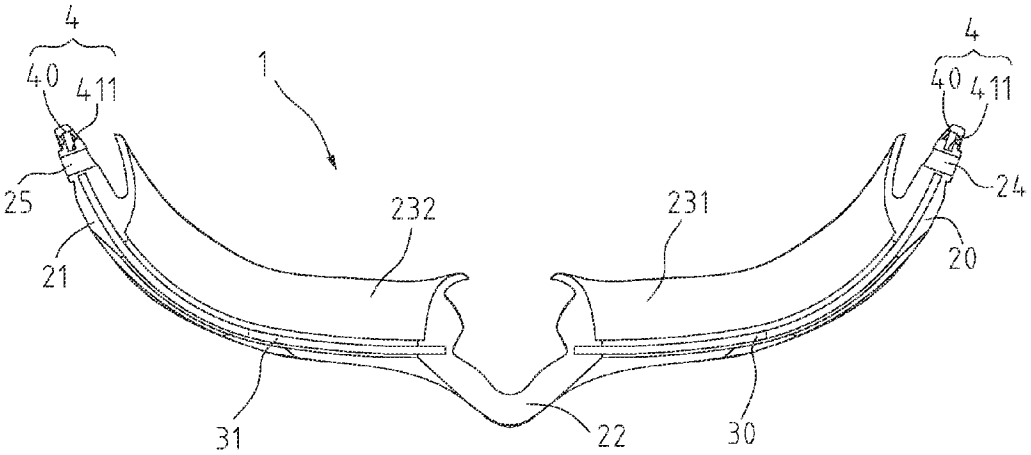
FIG. 4 is a cross-sectional view taken along line 3-3 in FIG. 3.

Referring to FIG. 1 in combination with FIG. 4, the swimming goggles 1 of the present invention, in assembly, is to utilize integral injection molding technique to integrally form the left and right frames 20 and 21, and the connecting element 22, wherein when the lenses 30 and 31 and the main bodies 40 of the buckles 4 are being embedded in respective left and right frames 20 and 21, the assembly is finished. Thus the swimming goggles 1 is simplified in structure and is light and handy in design through the integration of the main bodies 40 of the buckles 4 and the lenses 30 and 31. Furthermore, a head strap can be provided with hooks (not shown) to directly hook over the through holes 411 of the main bodies 40. Alternatively, a head strap is fastenable with the buckles 4 through other connecting elements (not shown).

Figure 5:
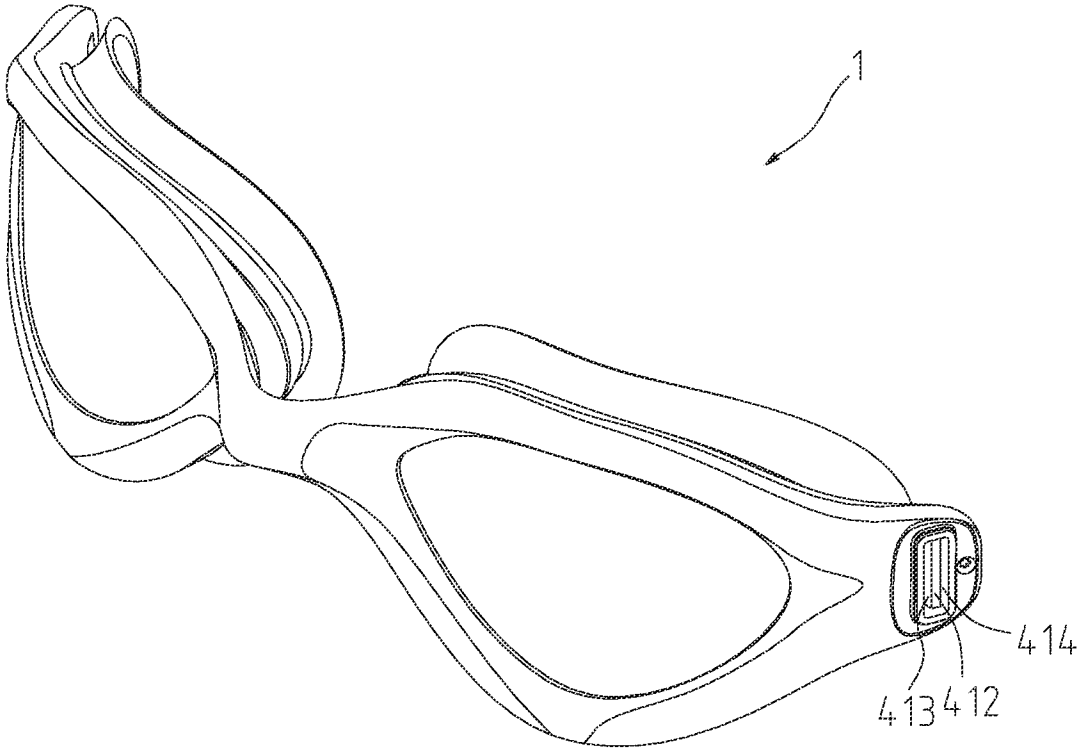
FIG. 5 is a perspective view of swimming goggles in accordance with a second embodiment of the present invention.

Referring to FIG. 5 illustrating a second embodiment of the present invention, a major difference between this embodiment and the preceding embodiment is that a rectangular pillar 412 is longitudinally disposed in the through hole 411 of the main body 40. The rectangular pillar 412 divides the through hole 411 into a first guiding portion 413 and a second guiding portion 414 so as to enable a tightening or loosening adjustment of the head strap (detailed processes are described below).

Figure 6A:
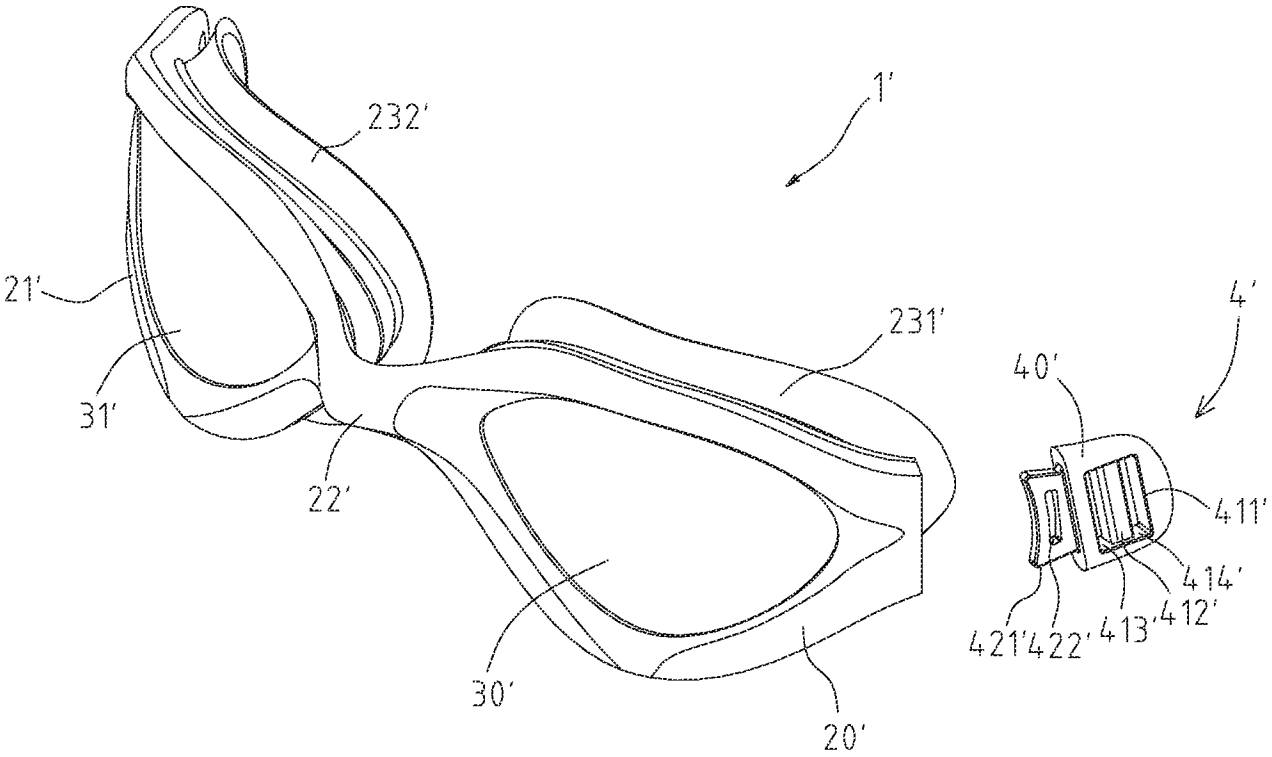
FIGS. 6A is a partially exploded perspective view of swimming goggles in accordance with a third embodiment of the present invention.
Figure 6B:
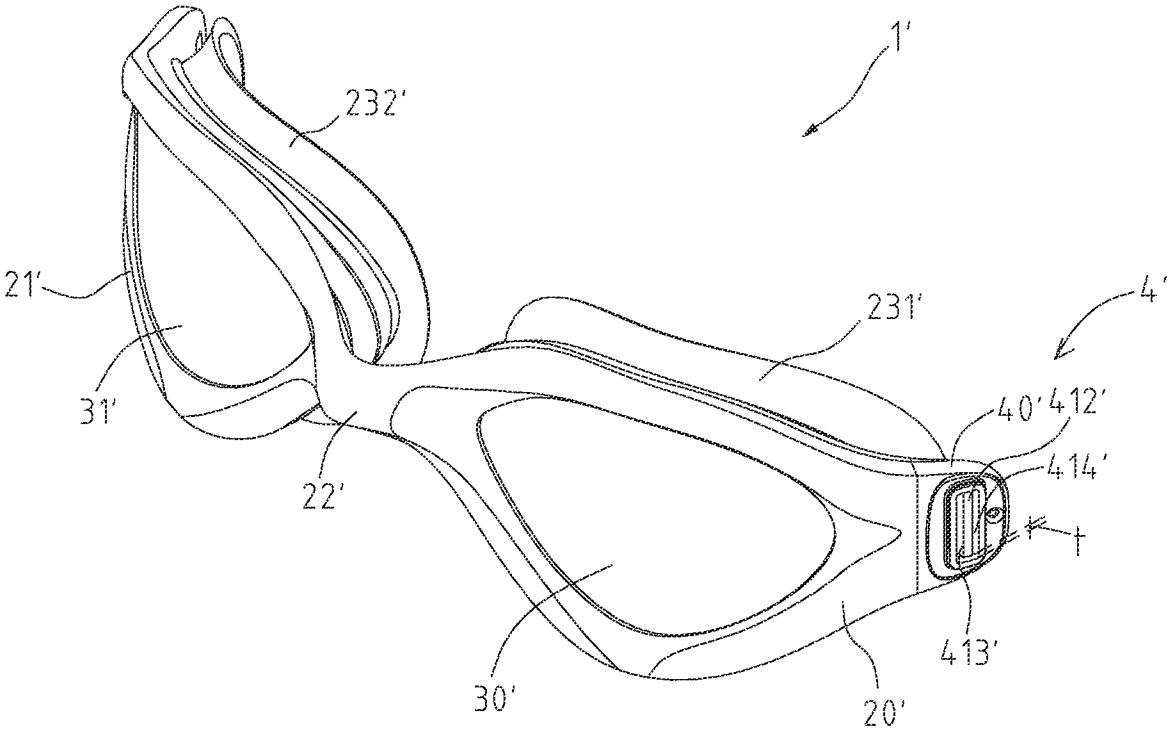
FIG. 6B is a perspective assembly view of FIG. 6A.
Figure 6C:
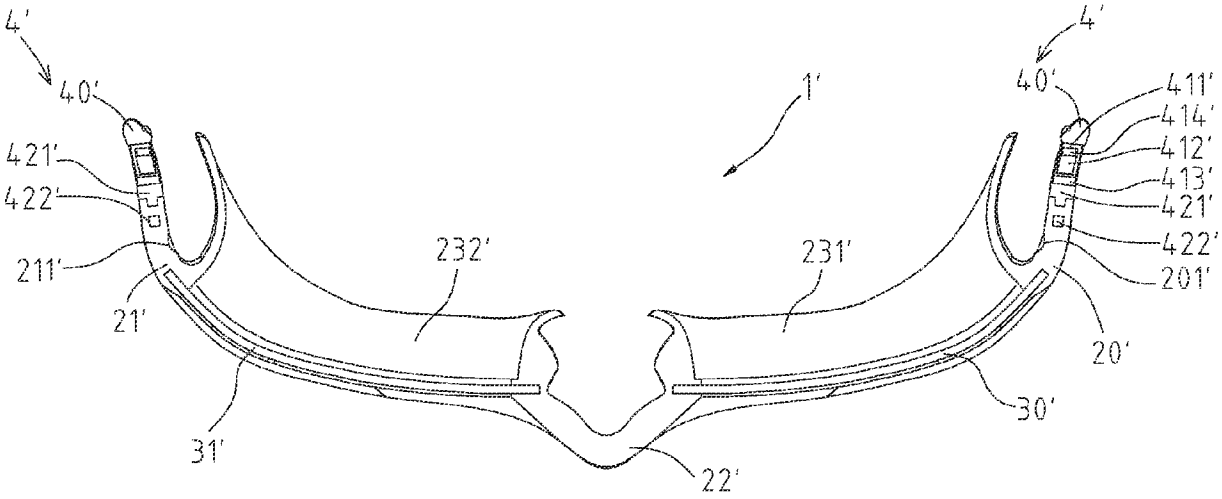
FIG. 6C is a schematic sectional view of FIG. 6B.

Referring to FIGS. 6A, 6B and 6C illustrating a third embodiment of the present invention, likewise, swimming goggles 1' of this embodiment comprise the left and right frames 20' and 21', the connecting element 22', the lenses 30' and 31', and the buckles 4'. Different features between this embodiment and the first embodiment are as follows: the main body 40' of the buckle 4' is smoothly connected to the side portion of the left/right frame 20' and 21' in such a manner that upper and lower sides of the main body 40' are smoothly connected with upper and lower sides of the side portion of the left/right frame 20' and 21'. Therefore, the buckle 4' forms a part of the left/right frame 20' and 21'. Additionally, the rectangular pillar 412' is longitudinally disposed in the through hole 411', wherein opposite sides of the rectangular pillar 412' are disposed facing internal walls of the through hole 411', and the through hole 411' is divided into the first and second guiding portions 413' and 414' by the rectangular pillar 412'. With the above mentioned structure, a head strap 5' is capable of passing through the first and second guiding portion 413' and 414', and is circled around and held against the rectangular pillar 412' at approximate 90 degrees. The rectangular pillar 412' is recessed from an outer surface of the main body 40' to form a gap t (shown in FIG. 6B) for covering a width of the head strap 5' and holding the head strap thereon. Furthermore, the main body 40' comprises a tongue portion 421' which is embedded in the side portions of the left/right frame 20' and 21'. The tongue portion 421' has a cavity 422' formed thereon for being filled with injection material during integral injection molding so as to provide a better grip between the side portion of the left/right frame 20' and 21' and the tongue portion 421'. Accordingly, the main bodies 40' are integrally attached to the side portions of the left and right frames 20' and 21'. Furthermore, the left and right frames 20' and 21' are respectively provided with notches 201' and 211' that are longitudinally formed on inner sides of the left and right frames 20' and 21', and are located adjacent to the tongue portions 421' and the lenses 30' and 31'. The notches 201' and 211' function as a fulcrum when the main bodies 40' are being pulled outward.

Figure 9:
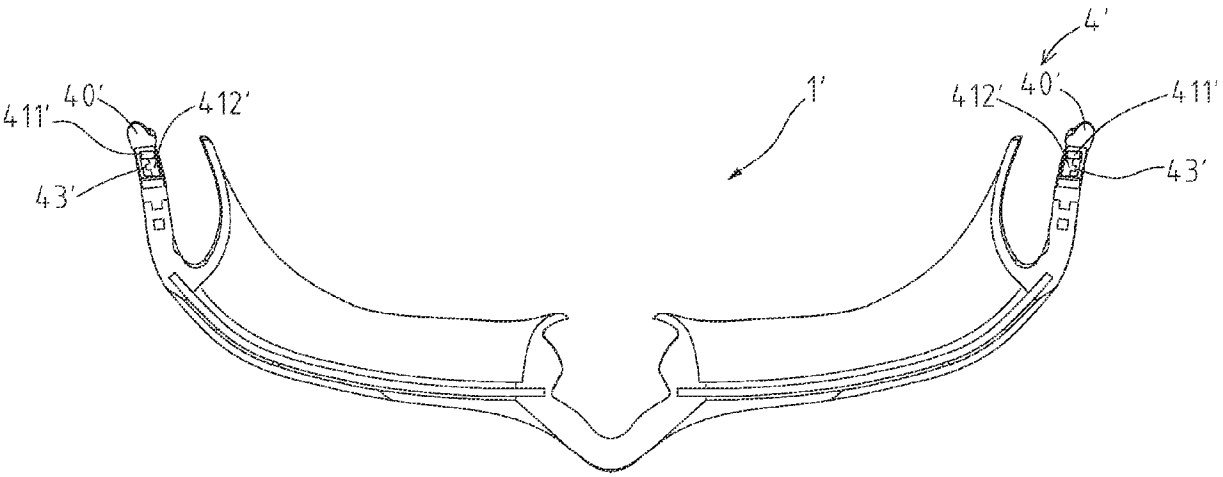
FIG. 9 is a schematic sectional view of swimming goggles in accordance with a fourth embodiment of the present invention.
Figure 7:
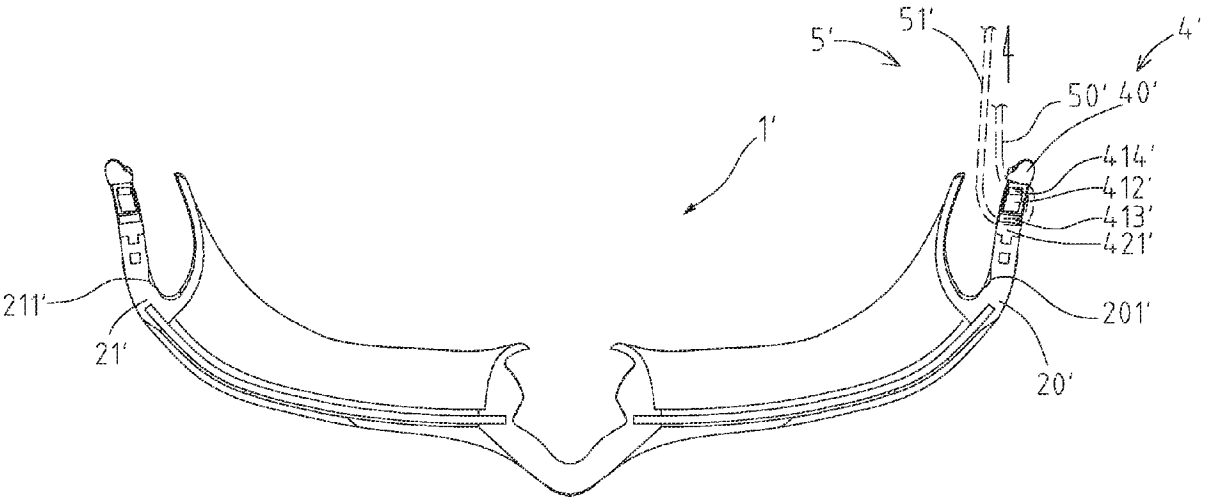
FIGS. 7 and 8 schematically show a head strap being assembled with and adjusted in the swimming goggles of FIG. 6C.
Figure 8:
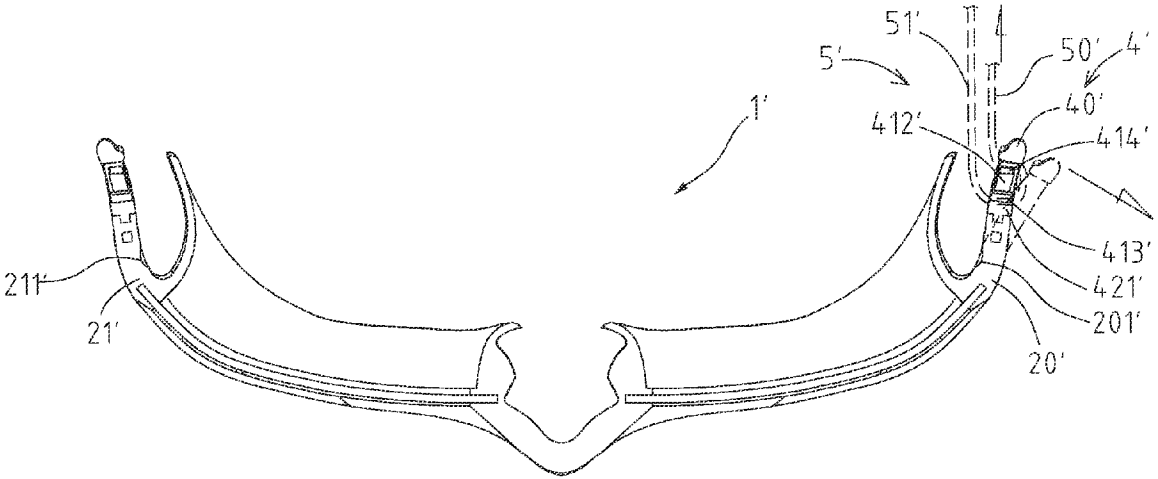

Referring to FIGS. 7-9, after wearing the swimming goggles 1', as shown in FIG. 7, the head strap 5' (shown only on one side of the swimming goggles 1') that passes through the first and second guiding portions 413' and 414' is only allowed to be adjusted in one direction. More specifically, the head strap 5' is defined with a guiding end 50' which passes through the first guiding portion 413' to go around the rectangular pillar 412' then through the second guiding portion 414' in such a manner that the head strap 5' is bent at approximate 90 degrees continuously to be around and against the rectangular pillar 412', whereby the guiding end 50' of the head strap 5' is capable of being drawn rearward (direction indicated as an arrow in FIG. 7) to tighten the head strap 5'. Other portion 51' of the head strap 5' is defined between a wearer's head and the rectangular pillar 412'. When the main body 40' is not pulled outward, the other portion 51' of the head strap 5' is not drawable because the other portion 51'is in frictional engagement with the rectangular pillar 412' by the head strap 5' circled around and against the rectangular pillar 412' at an approximate 90 degrees. When the head strap 5' is to be loosened, the main body 40' is being pulled outward (direction shown as an arrow in FIG. 8), wherein the notch 201' (211') functions as a fulcrum to facilitate pivoting of the main body 4', the other portion 51' of the head strap 5' is thus drawable rearward because an angle between the other portion 51' and the rectangular pillar 412' is increased. Consequently, adjustment of the head strap 5' for loosening or tightening is performed without taking off the swimming goggles V. Accordingly, the swimming goggles of the third embodiment is simplified in structure and is light and handy in design through the integration of the main bodies 40 and the lenses 30 and 31, and the rectangular pillar 412' enables a quick and easy adjustment of the head strap.

Further referring to FIG. 4 illustrating a forth embodiment of the present invention, a major difference between this and the third embodiment is that a rib 43' is formed on a surface of the rectangular pillar 412's. The rib 43' has a size smaller than the rectangular pillar 412' and forms a step-like shape together with the rectangular pillar 412'. As a result, a contact area of the head strap and the rectangular pillar 412' is reduced so that friction between the head strap and the rectangular pillar 412' is reduced as well. Therefore, the structure of the rib 43' enables a smooth adjustment of the head strap, and more specifically, the head strap is capable of being adjusted to be loosened by pulling the main body 4' outward at a smaller angle.

It is understood that the invention may be embodied in other forms within the scope of the claims. Thus the present examples and embodiments are to be considered in all respects as illustrative, and not restrictive, of the invention defined by the claims.

What is claimed is:

1. Swimming goggles, comprising:

left and right frames, and a connecting element for interconnecting the left and right frames as a unit, each of the left and right frames defined with a connecting opening;

lenses respectively installed in the connecting openings;

buckles integrally formed on side portions of the left and right frames respectively;

protection pads respectively disposed on the left and right frames; and a head strap being movably connected with the buckles;

wherein each of the buckles comprises a buckle main body which is disposed on and integrally formed with the corresponding side portion of the left/right frame, and the buckle main body is defined with a through hole which communicates opposite sides of the buckle main body;

wherein the buckle main body is smoothly connected to the side portion of the left/right frame in such a manner that upper and lower sides of the buckle main body are smoothly connected with upper and lower sides of the side portion of the left/right frame, and forms a part of the left/right frame;

wherein a rectangular pillar is longitudinally disposed in the through hole of the buckle main body, and divides the through hole into a first guiding portion and a second guiding portion; and wherein the buckle main body comprises a tongue portion having a cavity formed thereon for being integrally embedded into the side portion of the left/right frame.

2. The swimming goggles of claim 1, wherein opposite sides of the rectangular pillar are disposed facing internal walls of the through hole so as to support the head strap in such a manner that the head strap passes through the first and second guiding portions and is bent at approximate 90 degrees around and against the rectangular pillar, whereby the head strap is limited to be tightened from free ends thereof when wearing, and is released by pulling the buckle main body outward in order to loosen the head strap.

3. The swimming goggles of claim 2, wherein the rectangular pillar is recessed from an outer surface of the buckle main body and is further formed with a rib on a surface of the rectangular pillar, the rib has a size smaller than the rectangular pillar and forms a stair-step shape together with the rectangular pillar, whereby reducing a contact area of the head strap and the rectangular pillar and enabling a smooth movement of the head strap when loosening the head strap.

4. The swimming goggles of claim 1, wherein the left and right frames are respectively provided with notches formed on inner sides thereof and adjacent to the tongue portions, and the notches are functioned as a fulcrum when the buckle main body is being pulled outward.

5. The swimming goggles of claim 1, wherein the left and right frames, the connecting element, and the protection pads are integrally formed and made of thermal plastic rubber.

6. Swimming goggles, comprising:

left and right frames, and a connecting element for interconnecting the left and right frames as a unit, each of the left and right frames defined with a connecting opening;

lenses respectively installed in the connecting openings;

buckles integrally formed on side portions of the left and right frames respectively;

protection pads respectively disposed on the left and right frames; and a head strap being movably connected with the buckles;

wherein each of the buckles comprises a buckle main body which is disposed on and integrally formed with the corresponding side portion of the left/right frame, and the buckle main body is defined with a through hole which communicates opposite sides of the buckle main body;

wherein the buckle main body has a plate shape and integrally extends from an edge of each of the lenses into the side portion of the left/right frame, and the side portions of the left and right frames are formed with frame holes corresponding to the through holes;

wherein the buckle main body is smoothly connected to the side portion of the left/right frame in such a manner that upper and lower sides of the buckle main body are smoothly connected with upper and lower sides of the side portion of the left/right frame, and forms a part of the left/right frame;

wherein a rectangular pillar is longitudinally disposed in the through hole of the buckle main body, and divides the through hole into a first guiding portion and a second guiding portion;

wherein opposite sides of the rectangular pillar are disposed facing internal walls of the through hole so as to support the head strap in such a manner that the head strap passes through the first and second guiding portions and is bent at approximate 90 degrees around and against the rectangular pillar, whereby the head strap is limited to be tightened from free ends thereof when wearing, and is released by pulling the buckle main body outward in order to loosen the head strap; and wherein the rectangular pillar is recessed from an outer surface of the buckle main body and is further formed with a rib on a surface of the rectangular pillar, the rib has a size smaller than the rectangular pillar and forms a stair-step shape together with the rectangular pillar, whereby reducing an contact area of the head strap and the rectangular pillar and enabling a smooth movement of the head strap when loosening the head strap.

7. The swimming goggles of claim 6, wherein the left and right frames are respectively provided with notches formed on inner sides thereof, and the notches are functioned as a fulcrum when the buckle main body is being pulled outward.

8. The swimming goggles of claim 6, wherein the left and right frames, the connecting element, and the protection pads are integrally formed and made of thermal plastic rubber.

* * * * *